US006431251B1

(12) United States Patent
Yerusalim et al.

(10) Patent No.: US 6,431,251 B1
(45) Date of Patent: Aug. 13, 2002

(54) MID-WALL HANGER

(75) Inventors: Norman Yerusalim, Wyncote, PA (US); George Woodard, St. Louis, MO (US); Kenneth Huber, Seattle, WA (US)

(73) Assignee: Snap-Tex International L.L.C., Fort Washington, PA (US)

( * ) Notice: Subject to any disclaimer, the term of this patent is extended or adjusted under 35 U.S.C. 154(b) by 0 days.

(21) Appl. No.: 09/722,951

(22) Filed: Nov. 27, 2000

(51) Int. Cl.[7] ..... A47H 23/00
(52) U.S. Cl. ..... 160/327; 52/222
(58) Field of Search ..... 160/327, 328, 160/368.1; 52/222; 24/543, 559

(56) References Cited

U.S. PATENT DOCUMENTS 2,597,401 A * 5/1952 Swanson
4,403,642 A 9/1983 Morris
4,549,334 A 10/1985 Miller
4,625,490 A * 12/1986 Baslow
4,676,016 A 6/1987 Phillips et al.
4,805,330 A 2/1989 Bubernak
4,817,699 A 4/1989 Fein
5,230,377 A 7/1993 Berman
6,164,364 A * 12/2000 Morris

FOREIGN PATENT DOCUMENTS

GB 2039982 8/1980

* cited by examiner

*Primary Examiner*—Blair M. Johnson
(74) *Attorney, Agent, or Firm*—Caesar, Rivise, Bernstein, Cohen & Pokotilow, Ltd.

(57) ABSTRACT

This invention relates to wall hanging systems in general, and particularly to a new single body device which embodies the seam between two adjacent fabric panels and overcomes the problems inherent in wall hanging systems in use presently for the installation of fabric or acoustical panels.

3 Claims, 3 Drawing Sheets

MID-WALL HANGER

FIELD OF THE INVENTION

This invention relates to fabric wall hanging systems in general, and particularly to a new system to hang fabric panels at mid-wall which consists of a single-body elongated device secured vertically onto a wall into which the vertical perimeter edges of the fabric to be installed is admitted and secured therein thus defining the seam between adjoining fabric panels. By embodying the seam between adjoining fabric panels within a single device, the present invention overcomes many of the difficulties encountered in conventional wall hanging systems.

BACKGROUND OF THE INVENTION

The conventional method of installing fabric wall coverings to mid-wall surfaces requires first securing track onto the wall and then fitting and attaching the fabric onto the track framework. Typically, the track is attached to the wall along the vertical perimeter defining the panel or incremental space to be covered. Fabric is hung or attached to walls in incremental vertical sections or panels since an extended length of fabric will not hang taut and will tend to drape, thus ruining the esthetic goal of a smooth stretched fabric surface. Thus, an expanse of wall to be covered in fabric is divided into multiple, incremental sections or panels to achieve a uniform, consistently smooth fabric surface. Past industry experience shows that installation by the conventional track method is problematic as it has required great skill and time-consuming precision to mount and align the pieces of track which will define the framework for the fabric panels. Notably, each section of track must be spaced precisely on the wall at the location where the fabric seam is intended to appear. As such, each panel is individually created and the "seam" between individual panels consists of the space allotted by the installer between adjacent individual panels. The installer thereby has the burden of maintaining equal spacing between each panel that he or she creates.

To obtain a uniform seam, each section of track must properly abut the adjacent panel. Therefore, considerable skill and patience is required in mounting the track framework to the wall since the slightest deviation from perfect alignment will mar the overall appearance of the fabric installation. Perfect alignment in the installation of the track framework onto the wall is critical since any irregularities will be visually apparent once the fabric has been attached and may require dismantling of the entire track installation.

PRIOR ART

Previous inventions have disclosed track-like devices made of plastic or other materials designed to enable fabric or textiles to be tightly and securely stretched over surfaces to create fabric and acoustical panels. The tracks are typically designed to be secured to wall or ceiling surfaces with fasteners (screws, nails, staples, etc.) or adhesives.

For example, U.S. Pat. No. 4,805,330 discloses a hanger for a wall covering from which sheet material is suspended. This patent discloses a single track device wherein a single edge of the fabric wall covering is admitted into the track device. As this patent shows a single edge device, no seam between the adjoining fabric panels is created.

U.S. Pat. No. 4,403,642 discloses a fabric support track assembly attachable to a wall to a create a framework on which fabric material may be mounted. The assembly includes a first elongated track with means to be secured to a wall and a second elongated track which has means to hinge and clamp onto the first track. This patent discloses a two part track device wherein a single edge of the fabric wall covering is admitted. As the patent shows only a single edge, no seam between the adjoining fabric panels is created.

U.S. Pat. No. 4,549,334 discloses a fabric mounting track system consisting of two parts, a back support plate and a hinge lock plate. The fabric mounting track of the invention holds the fabric by means of a set of lancings punched out from one of the two plates of which the track consists. This patent discloses a single track device wherein a single edge of the fabric wall covering is admitted and, thus, no seam between the adjoining fabric panels is created.

U.S. Pat. Nos. 4,676,016, (Reexamination B1 4, 676,016) and 4,805,330 both disclose a hanger for a wall covering comprising a flat elongated strip having interengageable jaws on its front face. Because these patents disclose a single track device wherein a single edge of the fabric wall covering is admitted, no seam between the adjoining fabric panels is created.

U.S. Pat. No. 4,817,699 shows an extruded plastic wall track for affixing fabric to a wall including an elongated base adapted to be secured to a wall. This patent discloses a single track device wherein a single edge of the fabric wall covering is admitted, thus no seam between adjoining fabric panels is created.

U.S. Pat. No. 5,230,377 shows a border piece for mounting a fabric sheet parallel to a plane surface comprising body and locking portions and a hinge portion joining the body and locking portions. This patent discloses a single track device wherein a single edge of the fabric wall covering is admitted. As the patent shows a single edge, no seam between the adjoining fabric panels is created.

GB 2,039,982 A shows a device for securing and tensioning flexible sheet material comprising a base member and a locking member. Because this patent discloses a single track device wherein a single edge of the fabric wall covering is admitted, no seam between adjoining fabric panels is created.

The patents cited herein above are incorporated by reference in their entirety.

The above wall hanging track systems are plagued by the previously discussed problem of installing the track in a uniform fashion onto the wall surface and obtaining consistent spacing of the two abutting tracks which define the perimeter of each panel section. As happens in many installations, improper space is allotted at mid-wall between the tracks of adjoining panels. To correct such a problem often the entire project must be dismantled. However, the seam uniquely embodied within the present invention eliminates this hazard.

SUMMARY OF THE PRESENT INVENTION

The device of the present invention discloses a design that overcomes the above described problems suffered by the prior art by fusing two opposing locking devices into one piece in such a manner so as to accommodate almost any thickness of fabric and embody the seam of the contiguous fabric panels within the device itself. The single-body design of the device of the present invention guarantees a uniform and consistent seam between the individual sections or panels of fabric.

In place of track, the device of the present invention presents two opposing locking devices amalgamated into a single piece which can accommodate almost any thickness or weight of fabric. More importantly, the device of the present invention admits within its central interior cavity the ends of the fabric lengths which will form adjacent fabric panels thus guaranteeing a uniform seam where the fabric pieces are inserted and joined. A further benefit of the present device is that once installed, old fabric may be removed and replaced with new fabric without requiring the dismantling of tracks as in prior art hanging systems. The device of the present invention permits fabric to be removed and reinstalled by virtue of the flexible hinges running along either side of the device. In this way, the unique flexible hinges of the device allow the device to be reused since old fabric may be released and replaced with new fabric of the same or a different weight or thickness.

Thus, the device of the present invention produces a smooth taut surface for each fabric panel and assures uniform spacing between the individual panels since each length of fabric is held by a single molded piece rather than two separate pieces of track.

Although the fusing of two tracks and orienting them to create a seam may not seem to be an extraordinarily novel idea, such a simple solution has eluded the industry for many years. With device of the present invention, industry may now easily hang fabric wall coverings in panels having consistently uniform, tight seams and may reuse the same device for future fabric installations.

DETAILED DESCRIPTION OF PREFERRED EMBODIMENTS

Figure 1:
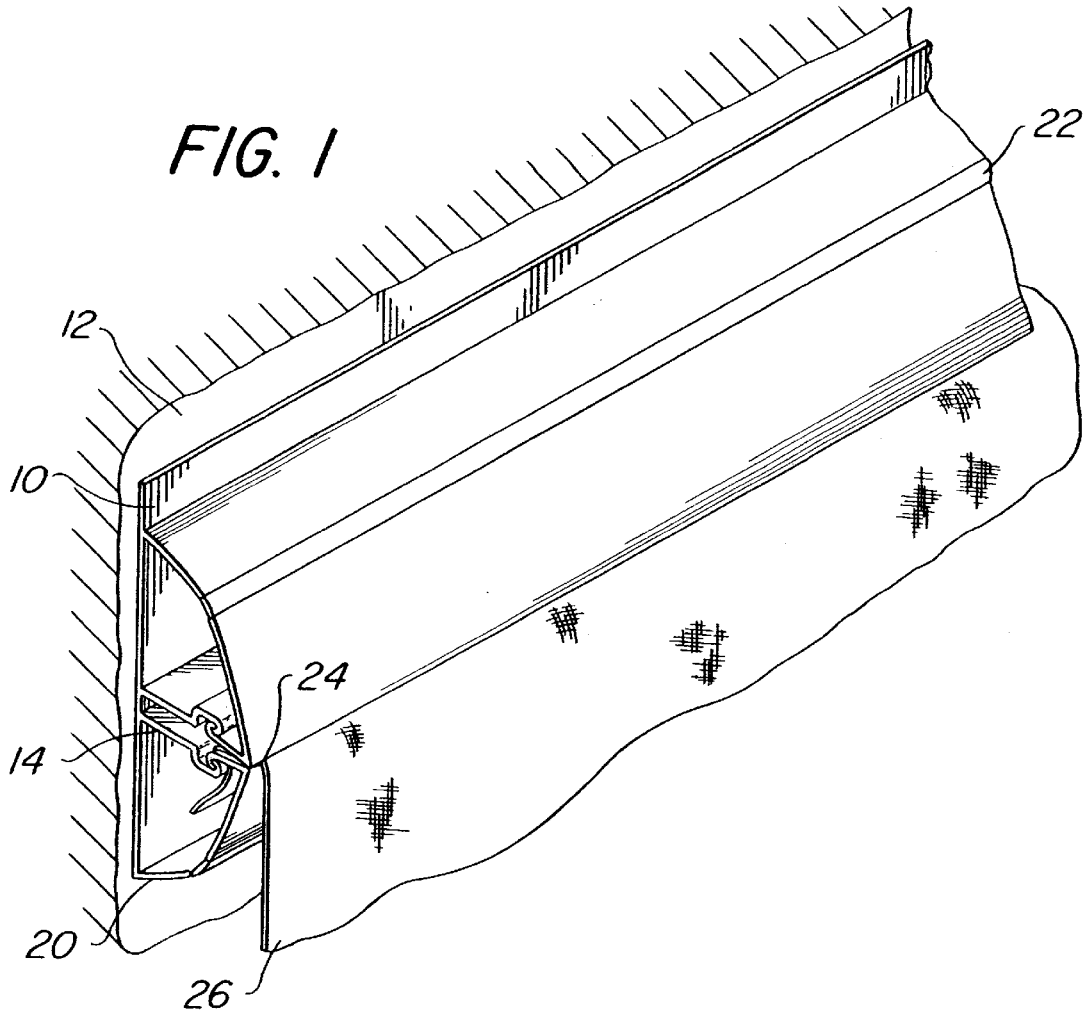
FIG. 1 is a sectional view of the device of the present invention attached by conventional means to a mid-wall surface in its locked, engaged state with fabric inserted and locked into one side of the device.

The present invention is a device which in FIG. 1 has an flat elongated surface of generally rectangular shape which serves as a base 10 and is a strip mountable to a surface such as a wall 12.

Figure 2:
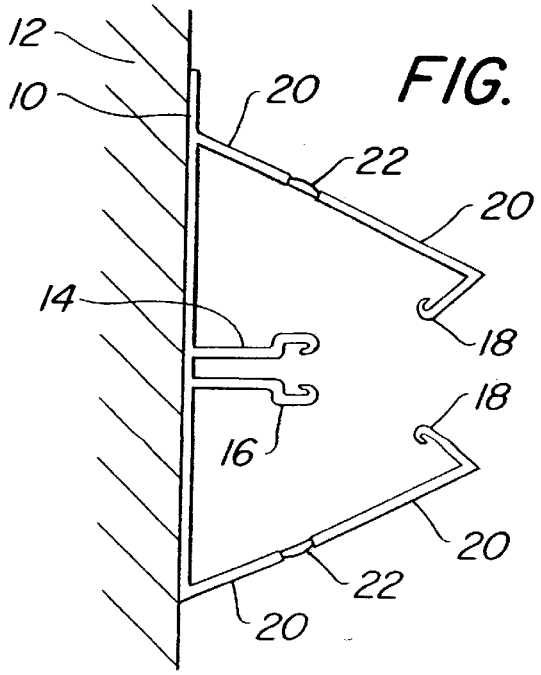
FIG. 2 is a cross-sectional view of the device of the present invention attached by conventional means to a mid-wall surface in its unlocked disengaged state ready for the introduction of fabric.

FIGS. 1 and 2 show that at approximately the midpoint of the width of the base 10 of present invention two closely spaced inner parallel walls 14 rise upward at right angles, with each of the two inner walls terminating in a hooked jaw 16. In cross-sectional view, FIGS. 2, 3, 4, and 6, the two inner jaws curve upward and inward in the form of a question mark, each jaw 16 facing the other. Each inner jaw is capable of mating with a corresponding exterior locking hooked jaw 18. In an alternative embodiment, the two parallel walls 14 may be replaced by a single wall (not shown) from which the hooked jaws 16 extend. The embodiment having two walls 14, is preferred as it is easier to work with.

In its open and disengaged state, FIG. 2, the device presents two exterior walls 20 which extend outward from the base 10 in the same direction as the two inner walls 14 and rise from the perimeters of the device's elongated base 10 measuring approximately three times the length of the inner walls 14. Located on the exterior wall at approximately one-third up from the base 10, is a pre-determined bend or flexible joint 22 which allows the exterior wall 20 to bend inward and gives the walls sufficient flexibility so as allow them to be manipulated downward so that the device may assume its engaged state, FIGS. 1, 4, 5, and 6. Likewise, the flexible joints 22 allow the exterior walls 20 to be bent outward when the device is in its disengaged state, FIGS. 2 and 3.

The flexible joint 22 is preferably formed of three pieces of flexible material such as a flexible plastic and these pieces may be fixedly secured together in ways known to those skilled in the art. One typical way in which these three pieces may be joined is by fusing or welding them together.

Figure 4:
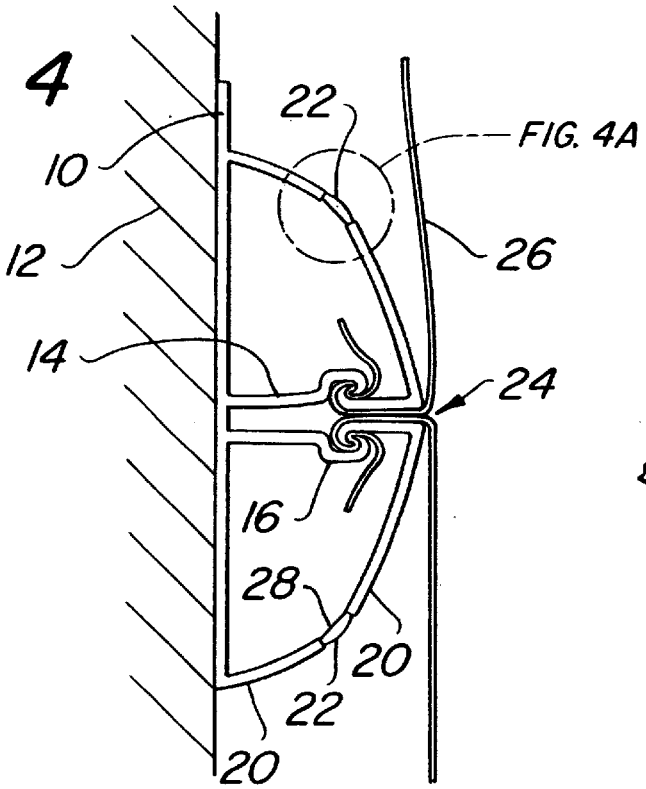
FIG. 4 is a cross-sectional view of the device of the present invention secured by conventional means to a mid-wall surface in its locked engaged state with fabric ends inserted into both sides of the device with said fabric ends stretched taut parallel to the surface of the wall to show a smooth surface when viewed from the exterior.
Figure 4A:
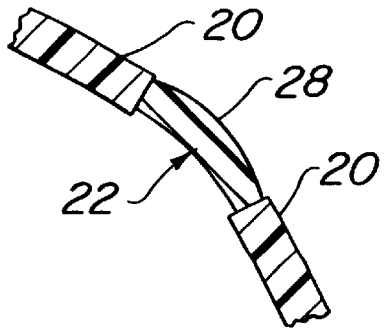
FIG. 4A is an enlarged view of the area bounded by a dotted line circle in FIG. 4 which shows a flexible joint in the exterior wall of the device.

As shown in FIG. 4A, the joint 22 is formed by the exterior wall 20, a central portion 28 and wall 30. Alternatively, the flexible joint may be made in one piece by conventional molding techniques known to those skilled in the art.

Where the tri-partite joint 22 is utilized, the exterior wall 20 may be comprised of a plastic such as polyvinyl chloride (PVC), while the central portion 28 may be comprised of a flexible plastic such as Dupont Hytrel™ or any other suitable flexible plastic although these materials may be varied depending upon the circumstances of use and desired flexibility properties known to those skilled in the art of such materials.

Terminating the tip of each exterior wall 20 is a hooked. jaw 18 which in cross-sectional view curves inward from distal end of both exterior walls 20. The exterior hooked jaws 18 are capable of mating and locking with the previously described inner jaws 16 of the device. The two sets of jaws may also be unlocked or disengaged to permit the exterior walls 20 to bend outward in the disengaged state of the device of the present invention.

To engage the device, as shown in FIGS. 1, 4, 5, and 6, the exterior walls 20 which are flexible owing to the predetermined flexible joint 22 can be bent downward and toward the midpoint of the elongated base 10. As the exterior walls are pressed downward, the exterior jaws 18 contact and mate with the inner jaws 16 thus engaging the locking mechanism of the device. Once engaged, FIG. 4, the exterior walls 20 arch inward toward the midpoint of the device. The predetermined flexible joint 22 in the exterior walls 20 allows the last two-thirds of the exterior wall to bend downward thus lowering and permitting the exterior jaw 18 to latch underneath the inner locking jaw 16. As the pairs of inner and exterior jaws have locked in place, the exterior walls form a semicircular convex arch FIGS. 1, 4, 5, and 6, and define the seam 24 between two adjoining fabric panels.

Figure 5:
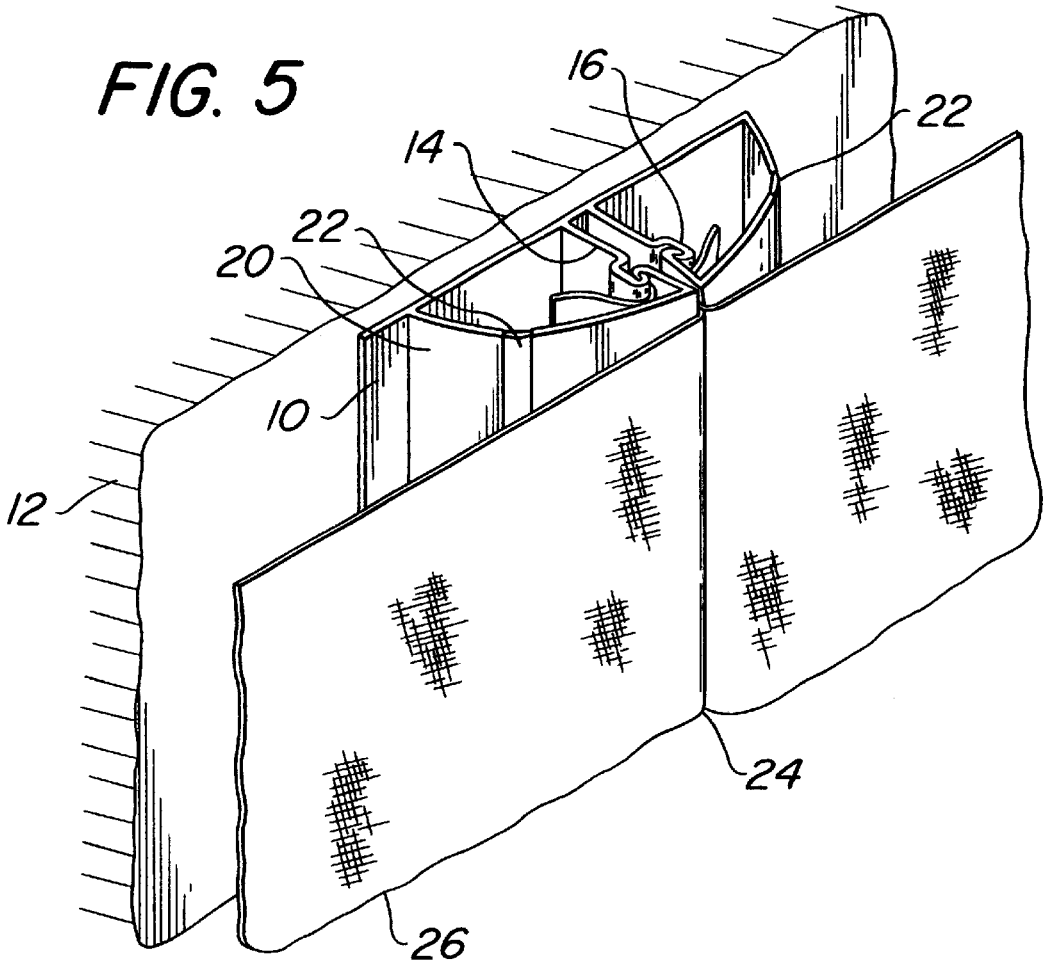
FIG. 5 is a frontal view of the device of the present invention secured to a mid-wall surface by conventional means in its locked engaged state with fabric ends inserted and locked into both sides of the device and showing the uniform seam created by the engaged device.
Figure 6:
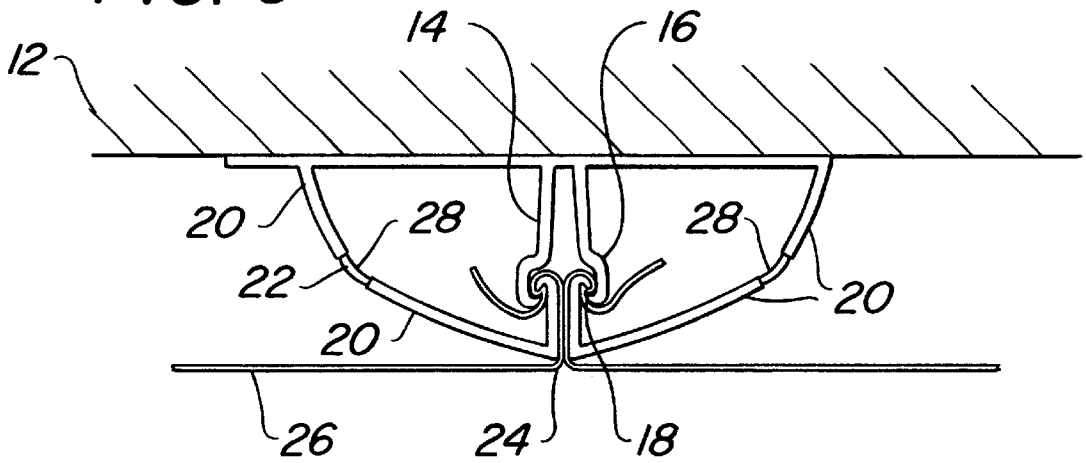
FIG. 6 is a cross-sectional view of the device of the present invention secured to a mid-wall surface by conventional means in its locked engaged position and showing fabric lengths stretched taut from the central seam and running parallel to the surface of the wall.

With the device in its locked and engaged state, FIGS. 1, 4, 5, and 6, a bend at the distal end of the exterior wall 20 and at the base of each exterior jaw 18 forms the opposing lips of a central seam 24, FIGS. 1 and 5, which runs down the midpoint of the length of the device of the present invention.

Figure 3:
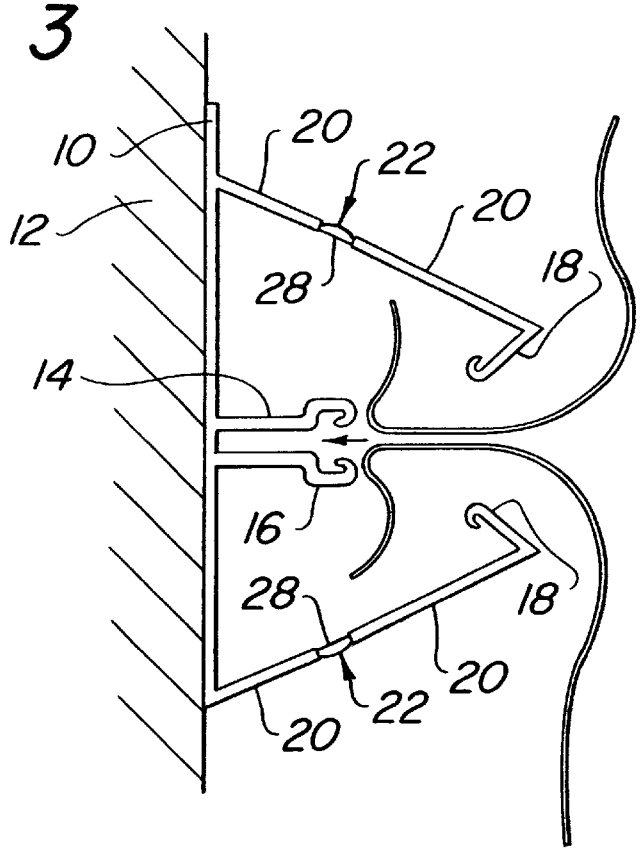
FIG. 3 is a cross-sectional view of the device of the present invention attached by conventional means to a mid-wall surface shown in its unlocked disengaged state with fabric ends inserted into both sides of the device.

Prior to engaging and locking the device, the ends of the desired lengths of fabric 26 which will form the seam 24 of the panel are admitted into the central interior cavity of the disengaged device alongside its interior length as shown in FIG. 3. With the fabric ends inserted into the device, the exterior walls 20 of the device may be manually bent inward toward the mid-section of the device and the two pairs of jaws locked and engaged. In this way, the ends of the fabric are trapped and secured as show in FIG. 4. With the ends of the fabric 26 secured in the device of the present invention, the fabric 26 is stretched taut across the area to be defined as the panel and its opposite end is secured into a separate, adjacent locking jaw of the device of the present invention, FIGS. 4, 5, and 6. In this way, a uniform fabric panel is created by the system.

Optionally, a double-faced conventional adhesive (not shown) will run along the length of the underside of the external wall 20 adjacent to its jaw 18. This optional adhesive is to aid installers in positioning and fitting the fabric 26 prior to actually engaging and locking the device of the present invention.

MANUFACTURE OF DESIGN

The device disclosed may be manufactured in a variety of rigid materials, most typically, rigid PVC, as this is acceptably flame retardant. Metal or other polymers may also be used. Because the device of the present invention can be manufactured at approximately the same cost as the manufacture of the two tracks that it replaces, the benefits of the device of the present invention are gained with no increase in cost of manufacturing materials.

The device of the present invention may be manufactured at a range of scale and dimensions. A typical embodiment would extend approximately one inch from the wall surface to which it is mounted with the device in its locked and engaged state, however, the device may be larger or smaller depending on the exigencies of its application.

Without further elaboration, the foregoing so fully illustrates the invention that others may, by applying current or future knowledge, readily adapt the same for use under various conditions of service.

We claim:

1. A device for hanging fabric wall coverings in the form of fabric panels comprising:

(a) a flat elongated planar base of generally rectangular shape which is mountable to a wall surface;

(b) at least one inner wall rising from the midpoint of the base terminating in hooked jaws;

(c) two parallel exterior walls extending from the length side perimeters of the base and beyond the length of the at least one inner wall, each having a tripartite hinge to allow for flexibility and a distal end which terminates in an exterior jaw capable of mating and locking with the corresponding jaws presented by the distal end of the at least one inner wall;

(d) an interior cavity wherein the ends of various thicknesses of fabrics and optional liners are admissible and which is defined by the exterior walls when the exterior walls are bent downward toward the midpoint of the panel by the interlocking exterior and inner jaws;

(e) a seam running the length of the device with lips defined by the pair of vertices which are present at a point where the exterior walls bend and terminate in the exterior jaws, which is the site where multiple fabric ends may be secured.

2. The device of claim 1, wherein a double-faced adhesive runs along the length of the face near its termination point or along the exterior wall jaw.

3. The device of claim 1 wherein the at least one inner wall comprises two parallel walls each of which terminates in a hooked jaw.

* * * * *